US009909784B2

(12) United States Patent
Toya et al.

(10) Patent No.: US 9,909,784 B2
(45) Date of Patent: Mar. 6, 2018

(54) OUTDOOR UNIT OF AIR CONDITIONER AND AIR CONDITIONER

(71) Applicant: FUJITSU GENERAL LIMITED, Kanagawa (JP)

(72) Inventors: Kotaro Toya, Kanagawa (JP); Makoto Shimotani, Kanagawa (JP); Hideya Tamura, Kanagawa (JP); Takahiro Matsunaga, Kanagawa (JP); Shinju Watanabe, Kanagawa (JP); Koji Ogata, Kanagawa (JP); Masaki Arai, Kanagawa (JP); Yasuhiro Oka, Kanagawa (JP); Ken Nakashima, Kanagawa (JP); Toshihiro Takahashi, Kanagawa (JP); Masakazu Sato, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 232 days.

(21) Appl. No.: 14/681,299

(22) Filed: Apr. 8, 2015

(65) Prior Publication Data

US 2016/0084535 A1 Mar. 24, 2016

(30) Foreign Application Priority Data

Sep. 18, 2014 (JP) ..... 2014-189804

(51) Int. Cl.
*F25B 5/04* (2006.01)
*F25B 13/00* (2006.01)

(52) U.S. Cl.
CPC ..... *F25B 5/04* (2013.01); *F25B 13/00* (2013.01); *F25B 2313/006* (2013.01);
(Continued)

(58) Field of Classification Search
CPC ..... F25B 13/00; F25B 2323/029; F25B 2323/006; F25B 2313/02742;
(Continued)

(56) References Cited

U.S. PATENT DOCUMENTS 5,689,962 A * 11/1997 Rafalovich ..... F24F 3/153 62/324.1
5,720,179 A * 2/1998 Jung ..... F24F 3/065 165/207

(Continued)

FOREIGN PATENT DOCUMENTS

JP 2005-337659 12/2005
JP 5463995 4/2014

*Primary Examiner* — Kun Kai Ma
(74) *Attorney, Agent, or Firm* — Rankin, Hill & Clark LLP

(57) ABSTRACT

An outdoor unit of an air conditioner coupled to an indoor unit by a liquid pipe and a gas pipe, includes: a compressor; an outdoor heat exchanger; a discharge pipe coupled to a refrigerant discharge side of the compressor; an intake pipe coupled to a refrigerant intake side of the compressor; an outdoor-unit high-pressure gas pipe coupled to the discharge pipe; an outdoor-unit low-pressure gas pipe coupled to the intake pipe; an outdoor-unit liquid pipe that couples a first refrigerant entry/exit opening of the outdoor heat exchanger and the liquid pipe together; a bypass pipe coupled to the outdoor-unit liquid pipe; a first flow-passage switcher coupled to a second refrigerant entry/exit opening of the outdoor heat exchanger, the discharge pipe, the intake pipe, and the bypass pipe; and a second flow-passage switcher coupled to the gas pipe, the outdoor-unit high-pressure gas pipe, and the outdoor-unit low-pressure gas pipe.

16 Claims, 3 Drawing Sheets

(52) U.S. Cl.
CPC . *F25B 2313/029* (2013.01); *F25B 2313/0231* (2013.01); *F25B 2313/0233* (2013.01); *F25B 2313/0252* (2013.01); *F25B 2313/0253* (2013.01); *F25B 2313/02742* (2013.01)

(58) Field of Classification Search
CPC ..... F25B 2313/0233; F25B 2313/0252; F25B 2313/0253; F25B 2313/0231
See application file for complete search history.

(56) References Cited

U.S. PATENT DOCUMENTS 5,848,537 A * 12/1998 Biancardi ..... F04C 29/0007 62/324.6
6,244,057 B1 * 6/2001 Yoshida ..... F25B 13/00 62/151
8,047,011 B2 * 11/2011 Kawano ..... F25B 13/00 62/160
8,418,494 B2 * 4/2013 Shinozaki ..... F24F 1/26 62/324.1
9,651,267 B2 * 5/2017 Tamaki ..... F24D 19/1051
2003/0230107 A1 * 12/2003 Lee ..... F25B 13/00 62/324.6
2004/0074254 A1 * 4/2004 Hiwata ..... F25B 9/008 62/402
2005/0193749 A1 * 9/2005 Hwang ..... F25B 13/00 62/160
2006/0096306 A1 * 5/2006 Okaza ..... F25B 9/06 62/228.1
2006/0162353 A1 * 7/2006 Ha ..... F25B 13/00 62/149
2006/0179868 A1 * 8/2006 Yoon ..... F25B 13/00 62/324.6
2007/0130978 A1 * 6/2007 Honda ..... F25B 13/00 62/238.7
2007/0196227 A1 * 8/2007 Okamoto ..... F01C 13/04 418/60
2007/0246117 A1 * 10/2007 Naganawa ..... B21C 37/151 138/108
2008/0060365 A1 * 3/2008 Sakitani ..... F25B 9/008 62/114
2009/0165480 A1 * 7/2009 Sakitani ..... F25B 31/004 62/192
2010/0146998 A1 * 6/2010 Tomioka ..... F25B 13/00 62/228.3
2010/0170295 A1 * 7/2010 Okazaki ..... F04C 18/0215 62/510
2010/0199695 A1 * 8/2010 Shinozaki ..... F24F 1/26 62/238.7
2011/0023533 A1 * 2/2011 Shimazu ..... F25B 1/10 62/498
2011/0048053 A1 * 3/2011 Sekine ..... F25B 13/00 62/324.6
2011/0048054 A1 * 3/2011 Sekine ..... F25B 13/00 62/324.6
2012/0174610 A1 * 7/2012 Takayama ..... F25B 1/10 62/196.1
2013/0019622 A1 * 1/2013 Nakashima ..... F25B 13/00 62/160
2013/0081417 A1 * 4/2013 Tamura ..... F25B 13/00 62/160
2013/0145785 A1 * 6/2013 Nobuhiro ..... F25B 49/02 62/160
2013/0145786 A1 * 6/2013 Tamaki ..... F25B 13/00 62/161
2013/0167559 A1 * 7/2013 Kim ..... F25B 30/02 62/56
2013/0180274 A1 * 7/2013 Tamaki ..... F25B 13/00 62/115
2013/0192284 A1 * 8/2013 Kawai ..... F25D 21/06 62/156
2013/0227978 A1 * 9/2013 Kawai ..... F25B 49/02 62/160
2014/0157811 A1 * 6/2014 Shimazu ..... F25B 1/10 62/238.6
2014/0331712 A1 * 11/2014 Kan ..... F25B 43/02 62/470
2015/0068241 A1 * 3/2015 Sun ..... F25B 41/04 62/324.6
2015/0267925 A1 * 9/2015 Inada ..... F25B 13/00 62/509
2015/0292756 A1 * 10/2015 Takenaka ..... F25B 13/00 62/160
2016/0201951 A1 * 7/2016 Jeong ..... F25B 13/00 62/115
2016/0201952 A1 * 7/2016 Jeong ..... F25B 13/00 62/115
2016/0245536 A1 * 8/2016 Iwasaki ..... F25B 49/02

* cited by examiner

OUTDOOR UNIT OF AIR CONDITIONER AND AIR CONDITIONER

CROSS-REFERENCE TO RELATED APPLICATION

This application claims priority from Japanese Patent Application No. 2014-189804 filed with the Japan Patent Office on Sep. 18, 2014, the entire content of which is hereby incorporated by reference.

BACKGROUND

1. Technical Field

This disclosure relates to an outdoor unit of an air conditioner and an air conditioner.

2. Description of the Related Art

A conventional multi-chamber air conditioner includes, for example, at least one outdoor unit, a plurality of indoor units, and a refrigerant pipe that couples these members together. As this multi-chamber air conditioner, for example, there is known the air conditioner described in Japanese Patent No. 5463995 and the air conditioner described in JP-A-2005-337659. In the former air conditioner, all the indoor units perform cooling operation or heating operation. The latter air conditioner can perform what is called cooling/heating-free operation in which each indoor unit can selectively perform cooling operation and heating operation.

In the air conditioner disclosed in Japanese Patent No. 5463995, a plurality of outdoor units and a plurality of indoor units are coupled to one another by liquid pipes and gas pipes. All the indoor units perform any one of cooling operation and heating operation. On the other hand, in the air conditioner disclosed in JP-A-2005-337659, an outdoor unit, a plurality of indoor units, and the identical count of branching units to that of the indoor units are coupled to one another by liquid pipes, high-pressure gas pipes, and low-pressure gas pipes. Each indoor unit can selectively perform cooling operation or heating operation. In the following description, the air conditioner that includes a liquid pipe and a gas pipe as refrigerant pipes for coupling an outdoor unit and an indoor unit together is referred to as a double-pipe air conditioner. The air conditioner that includes a liquid pipe, a high-pressure gas pipe, and a low-pressure gas pipe as refrigerant pipes for coupling an outdoor unit and an indoor unit together is referred to as a triple-pipe air conditioner.

Now, the double-pipe air conditioner and the triple-pipe air conditioner differ in structure from each other. Specifically, the double-pipe air conditioner includes two pipes of the liquid pipe and the gas pipe as the refrigerant pipes for coupling the outdoor unit and the indoor unit together. Accordingly, the outdoor unit internally includes an outdoor-unit liquid pipe, which couples the liquid pipe and an outdoor heat exchanger together, and an outdoor-unit gas pipe, which couples the gas pipe and a four-way valve together.

On the other hand, the triple-pipe air conditioner includes three pipes of the liquid pipe, the high-pressure gas pipe, and the low-pressure gas pipe as the refrigerant pipes for coupling the outdoor unit, the indoor unit, and the branching unit to one another. Accordingly, the outdoor unit internally includes an outdoor-unit liquid pipe, an outdoor-unit high-pressure gas pipe, and an outdoor-unit low-pressure gas pipe. The outdoor-unit liquid pipe couples the liquid pipe and the outdoor heat exchanger together. The outdoor-unit high-pressure gas pipe couples a discharge pipe, which is coupled to a discharge side of a compressor, and the high-pressure gas pipe together. The outdoor-unit low-pressure gas pipe couples an intake pipe, which is coupled to an intake side of the compressor, and the low-pressure gas pipe together. As just described, in the triple-pipe air conditioner, a refrigerant circuit is formed by coupling the outdoor unit to the indoor unit and the branching unit using the three refrigerant pipes. On the other hand, in the double-pipe air conditioner, a refrigerant circuit s formed by coupling the outdoor unit to the indoor unit using the two refrigerant pipes. Accordingly, it is difficult to use the outdoor unit of the triple-pipe air conditioner as the outdoor unit of the double-pipe air conditioner.

Regarding the use of the outdoor unit of the triple-pipe air conditioner as the outdoor unit of the double-pipe air conditioner, for example, the following configuration is possible. That is, the outdoor unit includes the first four-way valve and the second four-way valve. The second four-way valve couples to the gas pipe, the outdoor-unit high-pressure gas pipe, and the outdoor-unit low-pressure gas pipe. It is possible to switch the second four-way valve so as to selectively couple any of the outdoor-unit high-pressure gas pipe and the outdoor-unit low-pressure gas pipe to the gas pipe. Switching the second four-way valve allows guiding the low-pressure refrigerant that flows in from the gas pipe during cooling operation into the outdoor unit or allows the high-pressure refrigerant that is discharged from the compressor during heating operation to flow out from the outdoor unit to the gas pipe. Accordingly, the outdoor unit of the triple-pipe air conditioner can be used as the outdoor unit of the double-pipe air conditioner.

SUMMARY

An outdoor unit of an air conditioner coupled to an indoor unit by a liquid pipe and a gas pipe, includes: a compressor; an outdoor heat exchanger; a discharge pipe coupled to a refrigerant discharge side of the compressor; an intake pipe coupled to a refrigerant intake side of the compressor; an outdoor-unit high-pressure gas pipe coupled to the discharge pipe; an outdoor-unit low-pressure gas pipe coupled to the intake pipe; an outdoor-unit liquid pipe that couples the first refrigerant entry/exit opening of the outdoor heat exchanger and the liquid pipe together; a bypass pipe coupled to the outdoor-unit liquid pipe; the first flow-passage switcher coupled to the second refrigerant entry/exit opening of the outdoor heat exchanger, the discharge pipe, the intake pipe, and the bypass pipe; and the second flow-passage switcher coupled to the gas pipe, the outdoor-unit high-pressure gas pipe, and the outdoor-unit low-pressure gas pipe.

DESCRIPTION OF THE EMBODIMENTS

Figure 1:
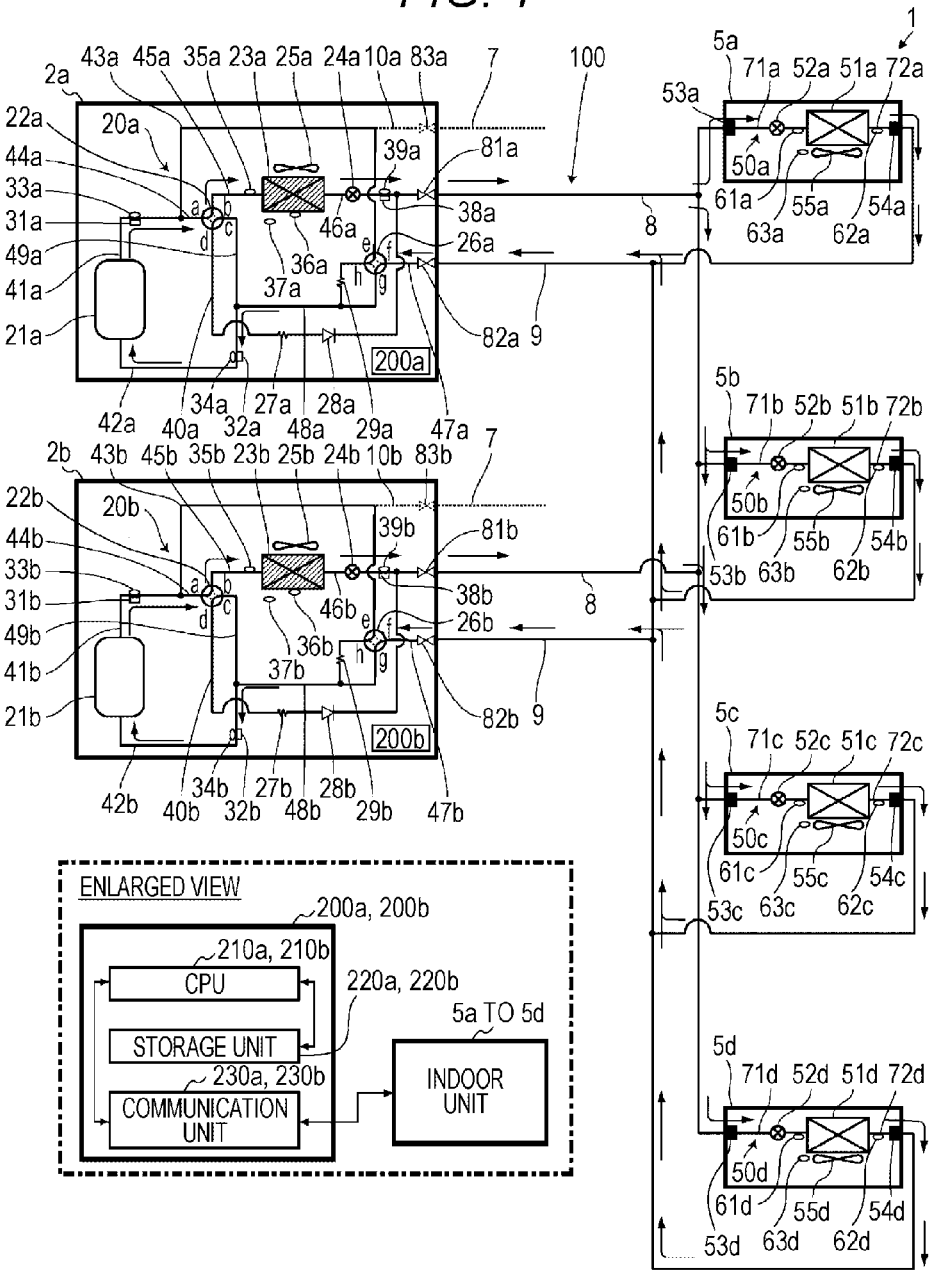
FIG. 1 is a refrigerant circuit diagram during cooling operation in an air conditioner according to an embodiment of this disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the case where the count of indoor units coupled to one outdoor unit is large, or in the case where the rating capacity per indoor unit to be coupled is large, one outdoor unit might not be able to cover the operation capacity required by all the indoor units. In this case, the count of outdoor units is increased to plural outdoor units. Corresponding to the operation capacity required by the indoor units, the count of operating outdoor units is increased.

In the above-described double-pipe air conditioner that employs the outdoor unit of the triple-pipe air conditioner with the second four-way valve, a plurality of outdoor units might be provided due to the above-described reason. In the case where there is an outdoor unit that is stopped during heating operation of this air conditioner, the following problem might occur.

Usually, in the outdoor unit of the triple-pipe air conditioner, respective three coupling ports out of four coupling ports of the first four-way valve couple to the discharge pipe, the refrigerant pipe coupled to the outdoor heat exchanger, and the intake pipe. The remaining coupling port couples to the refrigerant pipe that includes a decompressor and is coupled to the intake pipe. Respective three coupling ports out of four coupling ports of the second four-way valve couple to the gas pipe, the outdoor-unit high-pressure gas pipe, and the outdoor-unit low-pressure gas pipe. The remaining coupling port couples to the refrigerant pipe that includes a decompressor and is coupled to the outdoor-unit low-pressure gas pipe.

When the above-described air conditioner performs heating operation, the first four-way valve of each outdoor unit can be switched such that the refrigerant pipe coupled to the outdoor heat exchanger and the intake pipe communicate with each other. The second four-way valve is switched such that the outdoor-unit high-pressure gas pipe and the gas pipe communicate with each other. The switching state of each four-way valve described above is maintained in the first four-way valve and the second four-way valve in the outdoor unit that is stopped during heating operation.

During the heating operation described above, a part of the refrigerant discharged from the operating outdoor unit flows in the stopped outdoor unit via the gas pipe. The refrigerant that has flowed in the stopped outdoor unit flows in the outdoor-unit high-pressure gas pipe via the second four-way valve and then flows in the discharge pipe from the outdoor-unit high-pressure gas pipe. The refrigerant that has flowed in the discharge pipe flows in the refrigerant pipe, the intake pipe, and the outdoor heat exchanger via the first four-way valve. In the stopped outdoor unit, an outdoor expansion valve, which is provided at the outdoor-unit liquid pipe and adjusts the refrigerant flow rate in the outdoor heat exchanger, is fully closed. Accordingly, the refrigerant that has flowed in the outdoor heat exchanger does not flow out to the liquid pipe via the outdoor-unit liquid pipe. Thus, the refrigerant accumulates in the stopped outdoor unit.

As just described, continuing the heating operation in a state where there is a stopped outdoor unit causes an increase in amount of the refrigerant that accumulates in the outdoor heat exchanger of the stopped outdoor unit. As a result, this might cause a lack of the amount of the refrigerant that circulates between the operating outdoor unit and the indoor unit where the heating operation is performed.

One object according to the embodiment of this disclosure to reduce accumulation of refrigerant in a stopped outdoor unit in the case where a plurality of outdoor units of a triple-pipe air conditioner that can be used for a double-pipe air conditioner is used.

An outdoor unit of an air conditioner coupled to an indoor unit by a liquid pipe and a gas pipe according to an embodiment of this disclosure, includes: a compressor; an outdoor heat exchanger; a discharge pipe coupled to a refrigerant discharge side of the compressor; an intake pipe coupled to a refrigerant intake side of the compressor; an outdoor-unit high-pressure gas pipe coupled to the discharge pipe; an outdoor-unit low-pressure gas pipe coupled to the intake pipe; an outdoor-unit liquid pipe that couples the first refrigerant entry/exit opening of the outdoor heat exchanger and the liquid pipe together; a bypass pipe coupled to the outdoor-unit liquid pipe; the first flow-passage switcher coupled to the second refrigerant entry/exit opening of the outdoor heat exchanger, the discharge pipe, the intake pipe, and the bypass pipe; and the second flow-passage switcher coupled to the gas pipe, the outdoor-unit high-pressure gas pipe, and the outdoor-unit low-pressure gas pipe.

Moreover, the above described outdoor unit may include a valve (a solenoid valve or a check valve, for example) provided at the bypass pipe, the valve being for causing passage of a refrigerant from the first flow-passage switcher while cutting off a refrigerant toward the first flow-passage switcher.

Furthermore, the above described outdoor unit may include, during heating operation, the first flow-passage switcher coupling the second refrigerant entry/exit opening of the outdoor heat exchanger and the intake pipe together, and coupling the discharge pipe and the bypass pipe together, and the second flow-passage switcher coupling the gas pipe and the outdoor-unit high-pressure gas pipe together.

The outdoor unit of the air conditioner described above can reduce accumulation of the refrigerant in the stopped outdoor an even in the case where a plurality of outdoor units of the triple-pipe air conditioner is used as the outdoor unit of the double-pipe air conditioner.

Hereinafter, an embodiment of this disclosure will be described in detail based on the accompanying drawings. In the following air conditioner as one example of the embodiment, two outdoor units couple to four indoor units in parallel using two refrigerant pipes of a liquid pipe and a gas pipe. Furthermore, all the indoor units perform cooling operation or heating operation. Here, these two outdoor units are each an outdoor unit including the second four-way valve described later and used in a triple-pipe air conditioner that includes a high-pressure gas pipe, a low-pressure gas pipe, and a liquid pipe. These two outdoor units can be used as the outdoor units of a double-pipe air conditioner. This disclosure is not limited to the following embodiment. Various modifications are possible without departing from the spirit of this disclosure.

Figure 2:
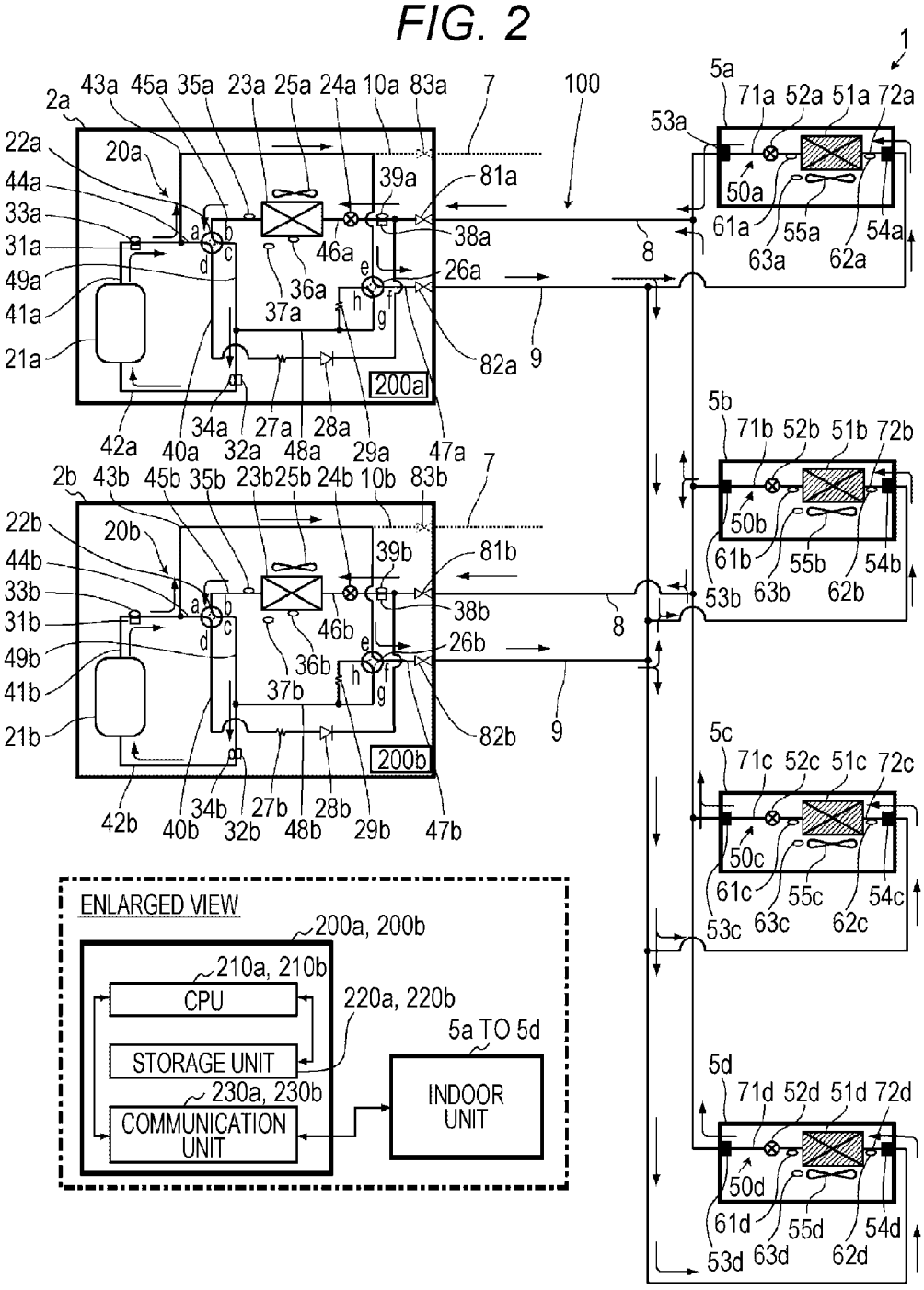
FIG. 2 is a refrigerant circuit diagram when heating operation is performed in a state where all of two outdoor units operate in the air conditioner according to the embodiment of this disclosure.
Figure 3:
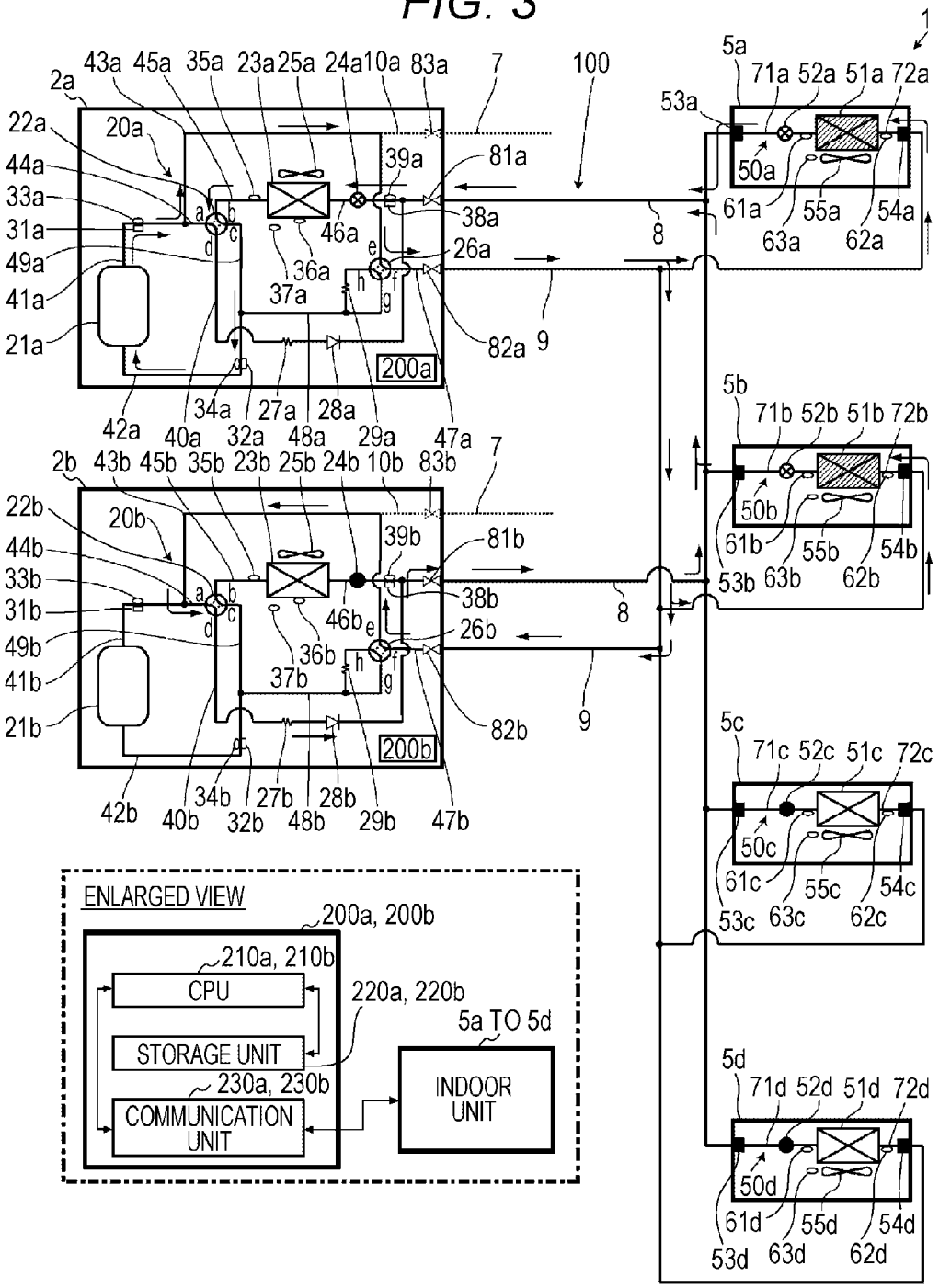
FIG. 3 is a refrigerant circuit diagram when heating operation is performed in a state where one outdoor unit is stopped in the air conditioner according to the embodiment of this disclosure.

As illustrated in FIGS. 1 to 3, an air conditioner 1 according to the embodiment of this disclosure is a double-pipe air conditioner. The air conditioner 1 includes two outdoor units 2*a* and 2*b*, which are installed outdoors, and four indoor units 5*a* to 5*d*, which are installed indoors. The indoor units 5*a* to 5*d* are coupled to the outdoor units 2*a* and 2*b* in parallel via liquid pipes 8 and gas pipes 9. In detail, one ends of the liquid pipes 8 are coupled to closing valves 81*a* and 81*b* of the outdoor units 2*a* and 2*b*. The other ends of the liquid pipes 8 are branched and coupled to respective liquid-pipe coupling portions 53*a* to 53*d* of the indoor units 5*a* to 5*d*, One ends of the gas pipes 9 are coupled to closing valves 82*a* and 82*b* of the outdoor units 2*a* and 2*b*. The other ends of the gas pipes 9 are branched and coupled to respective gas-pipe coupling portions 54*a* to 54*d* of the indoor units 5*a* to 5*d*. Thus, a refrigerant circuit 100 of the air conditioner 1 is constituted.

Firstly, the two outdoor units 2*a* and 2*b* will be described. The two outdoor units 2*a* and 2*b* respectively include compressors 21*a* and 21*b*, the first four-way valves 22*a* and 22*b* as the first flow-passage switchers, the second four-way valves 26*a* and 26*b* as the second flow-passage switchers, outdoor heat exchangers 23*a* and 23*b*, outdoor expansion valves 24*a* and 24*b*, closing valves 81*a* and 81*b*, closing valves 82*a* and 82*b*, and outdoor fans 25*a* and 25*b*, The closing valves 81*a* and 81*b* couple to the one ends of the liquid pipes 8. The closing valves 82*a* and 82*b* couple to the one ends of the gas pipes 9. These respective devices except the outdoor fans 25*a* and 25*b* and the respective refrigerant pipes, which couple these devices to one another, described in detail later constitute outdoor-unit refrigerant circuits 20*a* and 20*b*, which constitute a part of the refrigerant circuit 100.

Here, the outdoor units 2*a* and 2*b* have the identical configuration. Accordingly, in the following description, the configuration of the outdoor unit 2*a* will be described. On the other hand, the description of the outdoor unit 2*b* is omitted. In FIGS. 1 to 3, the reference numeral obtained by changing the end of the reference numeral given to the component device of the outdoor unit 2*a* from a to b will be the reference numeral indicative of the component device of the outdoor unit 2*b* corresponding to the component device of the outdoor unit 2*a*.

The compressor 21*a* is a capacity-variable compressor. That is, the operation capacity of the compressor 21*a* can be varied by being driven by a motor (not illustrated) whose rotational speed is controlled by an inverter. The refrigerant discharge side of the compressor 21*a* couples to one end of the discharge pipe 41*a*, The other end of the discharge pipe 41*a* is branched into an outdoor-unit high-pressure gas pipe 43*a* and a discharge branch pipe 44*a*. That is, the outdoor-unit high-pressure gas pipe 43*a* couples to the discharge pipe 41*a*. The outdoor-unit high-pressure gas pipe 43*a* couples to a port e of the second four-way valve 26*a* described later. The discharge branch pipe 44*a* couples to a port a of the first four-way valve 22*a* described later. That is, the discharge pipe 41*a* couples to the port a via the discharge branch pipe 44*a*.

The refrigerant intake side of the compressor 21*a* couples to one end of an intake pipe 42*a*. The other end of the intake pipe 42*a* is branched into an outdoor-unit low-pressure gas pipe 48*a* and an intake branch pipe 49*a*. That is, the outdoor-unit low-pressure gas pipe 48*a* couples to the intake pipe 42*a*. The outdoor-unit low-pressure gas pipe 48*a* couples to a port g of the second four-way valve 26*a* described later. The intake branch pipe 49*a* couples to a port c of the first four-way valve 22*a* described later. That is, the intake pipe 42*a* couples to the port c via the intake branch pipe 49*a*.

The first four-way valve 22*a* and the second four-way valve 26*a* are valves for switching the flow direction of the refrigerant. The first four-way valve 22*a* has four ports a, b, c, and d. The second four-way valve 26*a* has four ports e, f, g, and h. In the first four-way valve 22*a*, the port a couples to the discharge branch pipe 44*a* as described above. The port b is coupled to one refrigerant entry/exit opening (the second refrigerant entry/exit opening) of the outdoor heat exchanger 23*a* by the first coupling pipe 45*a*. The port c couples to the intake branch pipe 49*a* as described above. The port d couples to one end of a bypass pipe 40*a*, which includes a capillary tube 27*a* and a check valve 28*a*. The other end of the bypass pipe 40*a* couples to an outdoor-unit liquid pipe 46*a* described later. Accordingly, the port d couples to the outdoor-unit liquid pipe 46*a* via the bypass pipe 40*a*. This check valve 28*a* regulates the flow of the refrigerant to flow from the first four-way valve 22*a* to the outdoor-unit liquid pipe 46*a*. That is, this check valve 28 is the valve that is included in the bypass pipe 40*a* to cause passage of the refrigerant from the first four-way valve 22*a* while cutting off the refrigerant toward the first four-way valve 22*a*. Switching the first four-way valve 22*a* allows the high-pressure refrigerant that is discharged from the compressor 21*a* and flows through the discharge pipe 41*a* during cooling operation to flow to the first coupling pipe 45*a*, and allows the low-pressure refrigerant that has flowed in from the first coupling pipe 45*a* during heating operation to flow to the intake branch pipe 49*a*. In this embodiment, these bypass pipe 40*a* and check valve 28*a* are provided in the outdoor unit 2*a*.

In the second four-way valve 26*a*, the port e couples to the outdoor-unit high-pressure gas pipe 43*a* as described above. The port f couples to the gas pipe 9 via the closing valve 82*a* and the second coupling pipe 47*a*. The port g couples to the outdoor-unit low-pressure gas pipe 48*a* as described above. The port h couples to a branch pipe of the outdoor-unit low-pressure gas pipe 48*a*. This branch pipe includes a capillary tube 29*a*, and couples the port h and the outdoor-unit low-pressure gas pipe 48*a* together. Switching the second four-way valve 26*a* allows the low-pressure refrigerant that has flowed in from the gas pipe 9 during cooling operation to flow to the outdoor-unit low-pressure gas pipe 48*a*, and allows the high-pressure refrigerant that flowed in from the outdoor-unit high-pressure gas pipe 43*a* during heating operation to the gas pipe 9.

The outdoor heat exchanger 23*a* performs heat exchange between the refrigerant and the ambient air, which is taken in the inside of the outdoor unit 2*a* by rotation of the outdoor fan 25*a* described later. One refrigerant entry/exit opening of the outdoor heat exchanger 23*a* is, as described above, coupled to the port b of the first four-way valve 22*a* by the first coupling pipe 45*a*. The other refrigerant entry/exit opening (the first refrigerant entry/exit opening) of the outdoor heat exchanger 23*a* couples to one end of the outdoor-unit liquid pipe 46*a*. Here, the other end of the outdoor-unit liquid pipe 46*a* couples to the closing valve 81*a*. That is, the outdoor-unit liquid pipe 46*a* couples the other refrigerant entry/exit opening of the outdoor heat exchanger 23*a* and the liquid pipe 8 together.

The outdoor expansion valve 24*a* is provided at the outdoor-unit liquid pipe 46*a*. Adjustment of the degree of opening of the outdoor expansion valve 24*a* causes adjustment of: the refrigerant amount flowing in the outdoor heat exchanger 23*a*; or the refrigerant amount flowing out of the outdoor heat exchanger 23*a*. This outdoor expansion valve 24*a* is configured to close (for example, be fully closed) when the outdoor unit 2*a* is stopped. One end of the bypass pipe 40*a* described above is coupled between the outdoor expansion valve 24*a* of the outdoor-unit liquid pipe 46*a* and the closing valve 81*a*.

The outdoor fan 25*a* is formed of a resin material, and is disposed in the vicinity of the outdoor heat exchanger 23*a*. The outdoor fan 25*a* is rotated by a fan motor (not illustrated). Rotation of the outdoor fan 25*a* takes in the ambient air to the inside of the outdoor unit 2*a* from an inlet (not illustrated) and discharges the ambient air that exchanges heat with the refrigerant in the outdoor heat exchanger 23*a* to the outside of the outdoor unit 2*a* from an outlet (not illustrated).

Other than the configuration described above, the outdoor unit 2*a* is provided with various sensors. The discharge pipe 41*a* is provided with a high-pressure sensor 31*a* and a discharge-temperature sensor 33*a*. The high-pressure sensor 31*a* detects the pressure of the refrigerant discharged from the compressor 21*a*. The discharge-temperature sensor 33*a* detects the temperature of the refrigerant discharged from the compressor 21*a*. The intake pipe 42*a* is provided with a low-pressure sensor 32*a* and an intake-temperature sensor 34*a*. The low-pressure sensor 32*a* detects the pressure of the refrigerant suctioned into the compressor 21*a*. The intake-temperature sensor 34*a* detects the temperature of the refrigerant suctioned into the compressor 21*a*.

The first coupling pipe 45*a* is provided with the first heat-exchanger-temperature sensor 35*a*. The first heat-exchanger-temperature sensor 35*a* detects the temperature of: the refrigerant flowing in the outdoor heat exchanger 23*a*; or the refrigerant flowing out of the outdoor heat exchanger 23*a*. The outdoor heat exchanger 23*a* is provided with the second heat-exchanger-temperature sensor 36*a*. The second heat-exchanger-temperature sensor 36*a* detects the temperature of the refrigerant flowing in the middle of the outdoor heat exchanger 23*a*. In the vicinity of an inlet (not illustrated) of the outdoor unit 2*a*, an ambient-air-temperature sensor 37*a* is provided. The ambient-air-temperature sensor 37*a* detects the temperature of the ambient air flowing into the outdoor unit 2*a*, that is, the ambient air temperature. Between the outdoor expansion valve 24*a* and the closing valve 81*a* in the outdoor-unit liquid pipe 46*a*, an intermediate-pressure sensor 38*a* and a refrigerant temperature sensor 39*a* are provided. The intermediate-pressure sensor 38*a* detects the pressure of the refrigerant flowing through the outdoor-unit liquid pipe 46*a*. The refrigerant temperature sensor 39*a* detects the temperature of the refrigerant flowing through the outdoor-unit liquid pipe 46*a*.

The outdoor unit 2*a* includes an outdoor-unit controller 200*a*. The outdoor-unit controller 200*a* is mounted on a control board stored in an electrical equipment box (not illustrated) of the outdoor unit 2*a*. As illustrated in the main part enlarged views in FIGS. 1 to 3, the outdoor-unit controller 200*a* includes a CPU 210*a*, a storage unit 220*a*, and a communication unit 230*a*.

The storage unit 220*a* includes a ROM and/or a RAM. The storage unit 220*a* stores, for example, the control program for the outdoor unit 2*a*, the detected values corresponding to the detection signals from various sensors, and the controlled conditions of the compressor 21*a* and/or the outdoor fan 25*a*. The communication unit 230*a* is an interface to communicate with the indoor units 5*a* to 5*d*.

The CPU 210*a* takes in the detection results of the respective sensors in the outdoor unit 2*a* described above. The CPU 210*a* takes in the control signals transmitted from the indoor units 5*a* to 5*d* via the communication unit 230*a*. The CPU 210*a* controls the driving of the compressor 21*a* and the outdoor fan 25*a* based on the detection result and/or the control signal taken in. The CPU 210*a* controls switching of the first four-way valve 22*a* and the second four-way valve 26*a* based on the detection result and/or the control signal taken in. Additionally, the CPU 210*a* controls the degree of opening of the outdoor expansion valve 24*a* based on the detection result and/or the control signal taken in.

The following describes the four indoor units 5*a* to 5*d*. The four indoor units 5*a* to 5*d* respectively include indoor heat exchangers 51*a* to 51*d*, indoor expansion valves 52*a* to 52*d*, the liquid-pipe coupling portions 53*a* to 53*d*, the gas-pipe coupling portion 54*a* to 54*d*, and indoor fans 55*a* to 55*d*. The liquid-pipe coupling portions 53*a* to 53*d* couple to the other ends of the branched liquid pipes 8. The gas-pipe coupling portions 54*a* to 54*d* couple to the other ends of the branched gas pipes 9. These devices except the indoor fans 55*a* to 55*d* and the respective refrigerant pipes, which couple these devices to one another, described in detail later constitute indoor-unit refrigerant circuits 50*a* to 50*d*, which constitute a part of the refrigerant circuit 100.

Here, the indoor units 5*a* to 5*d* have the identical configuration. Accordingly, in the following description, the configuration of the indoor unit 5*a* will be described. On the other hand, the descriptions of the other indoor units 5*b* to 5*d* are omitted. In FIGS. 1 to 3, the reference numeral obtained by changing the end of the reference numeral given to the component device of the indoor unit 5*a* from a to b, c, and d will be the reference numerals indicative of the respective component devices of the indoor units 5*b*, 5*c*, and 5*d* corresponding to the component device of the indoor unit 5*a*.

The indoor heat exchanger 51*a* performs heat exchange between the refrigerant and the indoor air taken into the indoor unit 5*a* from a suction opening (not illustrated) by rotation of the indoor fan 55*a* described later. One refrigerant entry/exit opening of the indoor heat exchanger 51*a* is coupled to the liquid-pipe coupling portion 53*a* by an indoor-unit quid pipe 71*a*. The other refrigerant entry/exit opening of the indoor heat exchanger 51*a* is coupled to the gas-pipe coupling portion 54*a* by an indoor-unit gas pipe 72*a*. The indoor heat exchanger 51*a* functions as an evaporator in the case where the indoor unit 5*a* performs cooling operation. On the other hand, the indoor heat exchanger 51*a* functions as a condenser in the case where the indoor unit 5*a* performs heating operation.

Here, respective refrigerant pipes are coupled to the liquid-pipe coupling portion 53*a* and the gas-pipe coupling portion 54*a* by welding, flare nuts, or similar method.

The indoor expansion valve 52*a* is provided at the indoor-unit liquid pipe 71*a*. Adjustment of the degree of opening of the indoor expansion valve 52*a* causes adjustment of: the refrigerant amount flowing in the indoor heat exchanger 51*a*; or the refrigerant amount flowing out of the indoor heat exchanger 51*a*. The degree of opening of the indoor expansion valve 52*a* is adjusted corresponding to the required cooling capacity in the case where the indoor heat exchanger 51*a* functions as an evaporator. On the other hand, in the case where the indoor heat exchanger 51*a* functions as a condenser, the degree of opening of the indoor expansion valve 52*a* is adjusted corresponding to the required heating capacity.

The indoor fan 55*a* is formed of a resin material, and is disposed in the vicinity of the indoor heat exchanger 51*a*. The indoor fan 55*a* is rotated by a fan motor (not illustrated). Rotation of the indoor fan 55*a* takes in the indoor air to the inside of the indoor unit 5*a* from a suction opening (not illustrated) and supplies the indoor air that exchanges heat with the refrigerant in the indoor heat exchanger 51*a* to indoor from an outlet (not illustrated).

Other than the configuration described above, the indoor unit 5*a* is provided with various sensors. The indoor-unit liquid pipe 71*a* is provided with a liquid-side temperature sensor 61*a* between the indoor heat exchanger 51*a* and the indoor expansion valve 52*a*. The liquid-side temperature sensor 61*a* detects the temperature of: the refrigerant flowing in the indoor heat exchanger 51*a*; or the refrigerant flowing out of the indoor heat exchanger 51*a*. The indoor-unit gas pipe 72*a* is provided with a gas-side temperature sensor 62*a*. The gas-side temperature sensor 62*a* detects the temperature of: the refrigerant flowing out of the indoor heat exchanger 51*a*; or the refrigerant flowing in the indoor heat exchanger 51*a*. In the vicinity of a suction opening (not illustrated) of the indoor unit 5*a*, an indoor-temperature sensor 63*a* is provided. The indoor-temperature sensor 63*a* detects the temperature of the indoor air flowing into the indoor unit 5*a*, that is, an indoor temperature.

Here, as described above, the outdoor units 2*a* and 2*b* are originally used in a triple-pipe air conditioner. In the original configuration, as illustrated by the dotted lines in FIGS. 1 to 3, the outdoor units 2*a* and 2*b* respectively include closing valves 83*a* and 83*b* and high-pressure refrigerant pipes 10*a* and 10*b*. The closing valves 83*a* and 83*b* can be coupled to one ends of the high-pressure gas pipes 7. The high-pressure refrigerant pipes 10*a* and 10*b* respectively couple the outdoor-unit high-pressure gas pipes 43*a* and 43*b* to the closing valves 83*a* and 83*b*. However, in this embodiment, the outdoor units 2*a* and 2*b* are constituted to accommodate a double-pipe air conditioner. Thus, the outdoor units 2*a* and 2*b* do not respectively include the closing valves 83*a* and 83*b* and the high-pressure refrigerant pipes 10*a* and 10*b*. However, the outdoor units 2*a* and 2*b* may respectively keep the high-pressure refrigerant pipes 10*a* and 10*b* and the closing valves 83*a* and 83*b*.

The following describes the flow of the refrigerant in the refrigerant circuit 100 and the operations of the respective portions during operation of the air conditioner 1 according to this embodiment, using FIGS. 1 to 3. The air conditioner 1 according to this embodiment can perform cooling operation, which performs air cooling inside the room where the indoor units 5*a* to 5*d* are installed, and heating operation, which performs air heating inside the room where the indoor units 5*a* to 5*d* are installed.

The following describes the operations of the air conditioner 1 during the respective operations in the order corresponding to the cooling operation and the heating operation, using FIGS. 1 to 3 as necessary. FIG. 1 illustrates the state of the refrigerant circuit 100 and the flow of the refrigerant when all the four indoor units perform cooling operations and the two outdoor units operate. FIG. 2 illustrates the state of the refrigerant circuit 100 and the flow of the refrigerant when all the four indoor units perform heating operations and the two outdoor units operate. FIG. 3 illustrates the state of the refrigerant circuit 100 and the flow of the refrigerant when two indoor units perform heating operations, two indoor units are stopped, one outdoor unit operates, and one outdoor unit is stopped. Here, regarding the following description, the arrows in FIGS. 1 to 3 indicate the flow of the refrigerant in the refrigerant circuit 100. In FIGS. 1 to 3, the heat exchanger that functions as a condenser is hatched, and the heat exchanger that functions as an evaporator s outlined. Additionally, in FIG. 3, the closed expansion valve is painted black.

<Cooling Operation>

Firstly, a description will be given of the operation of the air conditioner 1 during cooling operation using FIG. 1. When performing the cooling operation, as illustrated in FIG. 1, the CPUs 210*a* and 210*b* of the outdoor-unit controllers 200*a* and 200*b* switch the respective first four-way valves 22*a* and 22*b* to cause the state illustrated by the solid lines, that is, to cause the communication between the port a and the port b and the communication between the port c and the port d. That is, the first four-way valves 22*a* and 22*b* are switched to couple one refrigerant entry/exit openings of the outdoor heat exchangers 23*a* and 23*b* and the discharge pipes 41*a* and 41*b* together and to couple the intake pipes 42*a* and 42*b* (the intake branch pipes 49*a* and 49*b*) and the bypass pipes 40*a* and 40*b* together. Accordingly, the outdoor heat exchangers 23*a* and 23*b* function as condensers, and the indoor heat exchangers 51*a* to 51*d* function as evaporators. The CPUs 210*a* and 210*b* switch the respective second four-way valves 26*a* and 26*b* to cause the state illustrated by the solid lines, that is, to cause the communication between the port e and the port h and the communication between the port f and the port g. That is, the second four-way valves 26*a* and 26*b* are switched to couple the outdoor-unit high-pressure gas pipes 43*a* and 43*b* and the branch pipes of the outdoor-unit low-pressure gas pipes 48*a* and 48*b* together and to couple the outdoor-unit low-pressure gas pipes 48*a* and 48*b* and the gas pipes 9 (the second coupling pipes 47*a* and 47*b*) together. Accordingly, the gas pipes 9 and the outdoor-unit low-pressure gas pipes 48*a* and 48*b* are coupled together via the second coupling pipes 47*a* and 47*b*.

When the refrigerant circuit 100 is in the above-described state, the high-pressure refrigerants, which are compressed by the respective compressors 21*a* and 21*b* inside the outdoor units 2*a* and 2*b* and discharged from these units, flow through the discharge pipes 41*a* and 41*b* and flow in the first four-way valves 22*a* and 22*b* via the discharge branch pipes 44*a* and 44*b*. Furthermore, these refrigerants flow in the outdoor heat exchangers 23*a* and 23*b* from the first four-way valves 22*a* and 22*b* via the first coupling pipes 45*a* and 45*b*. The refrigerants that have flowed in the outdoor heat exchangers 23*a* and 23*b* are condensed by heat exchange with the ambient air taken into the outdoor units 2*a* and 2*b* by rotations of the outdoor fans 25*a* and 25*b*. The high-pressure refrigerant that has flowed out of the outdoor heat exchangers 23*a* and 23*b* flow through the outdoor-unit liquid pipes 46*a* and 46*b* and pass through the outdoor expansion valves 24*a* and 24*b* that are fully opened. Then, these refrigerants flow in the liquid pipes 8 via the closing valves 81*a* and 81*b*.

The refrigerants flowing through the liquid pipes 8 branch and flow in the respective indoor units 5*a* to 5*d* via the liquid-pipe coupling portions 53*a* to 53*d*. Then, these high-pressure refrigerants flow through the indoor-unit liquid pipes 71*a* to 71*d*, and are decompressed when passing through the indoor expansion valves 52*a* to 52*d* so as to be low-pressure refrigerants. These low-pressure refrigerants flow in the indoor heat exchangers 51*a* to 51*d* via the indoor-unit liquid pipes 71*a* to 71*d*. Then, these low-pressure refrigerants are evaporated by heat exchange with the indoor air taken into the indoor units 5*a* to 5*d* by rotations of the indoor fans 55*a* to 55*d* in the indoor heat exchangers 51*a* to 51*d*. As just described, functioning of the indoor heat exchangers 51*a* to 51*d* as evaporators ensures air cooling inside the room where the indoor units 5*a* to 5*d* are installed.

The low-pressure refrigerants that have flowed out of the indoor heat exchangers 51*a* to 51*d* flow through the indoor-unit gas pipes 72*a* to 72*d* and flow in the gas pipes 9 via the gas-pipe coupling portions 54*a* to 54*d*. These low-pressure refrigerants flow through the gas pipes 9 and flow in the respective outdoor units 2*a* and 2*b* via the closing valves 82*a* and 82*b*. Furthermore, these low-pressure refrigerants flow in the second four-way valves 26*a* and 26*b* via the second coupling pipes 47*a* and 47*b*. Furthermore, these low-pressure refrigerants flow in the intake pipes 42*a* and 42*b* from the second four-way valves 26*a* and 26*b* via the outdoor-unit low-pressure gas pipes 48*a* and 48*b* and are suctioned into the compressors 21*a* and 21*b* so as to be compressed again.

As described above, circulation of the refrigerant in the refrigerant circuit 100 ensures the cooling operation of the air conditioner 1. At this time, the first four-way valves 22*a* and 22*b* cause flows of the high-pressure refrigerants discharged from the compressors 21*a* and 21*b*. On the other hand, the second four-way valves 26*a* and 26*b* cause flows of the low-pressure refrigerants suctioned into the compressors 21*a* and 21*b*.

The following describes the operations of the air conditioner 1 in the heating operation. Using FIG. 2, a description will be given of the case (heating operation 1) where all the four indoor units perform heating operations and all the two outdoor units operate. Further, using FIG. 3, a description will be given of the case (heating operation 2) where two indoor units perform heating operations, two indoor units are stopped, one outdoor unit operates, and one outdoor unit is stopped.

<Heating Operation 1>

Firstly, a description will be given of the operation of the air conditioner 1 in the case (heating operation 1) where all the four indoor units 5*a* to 5*d* operate and all the two outdoor units 2*a* and 2*b* operate, using FIG. 2. As illustrated in FIG. 2, in this heating operation 1, the CPUs 210*a* and 210*b* switch the respective first four-way valves 22*a* and 22*b* to cause the state illustrated by the solid lines, that is, to cause the communication between the port a and the port d and the communication between the port b and the port c in the first four-way valves 22*a* and 22*b*. That is, the first four-way valves 22*a* and 22*b* are switched to couple one refrigerant entry/exit opening of the outdoor heat exchangers 23*a* and 23*b* and the intake pipes 42*a* and 42*b* together and to couple the discharge pipes 41*a* and 41*b* (the discharge branch pipes 44*a* and 44*b*) and the bypass pipes 40*a* and 40*b* together. Accordingly, the outdoor heat exchangers 23*a* and 23*b* function as evaporators, and the indoor heat exchangers 51*a* to 51*d* function as condensers. The CPUs 210*a* and 210*b* switch the respective second four-way valves 26*a* and 26*b* to cause the state illustrated by the solid lines, that is, to cause the communication between the port e and the port f and the communication between the port g and the port h in the second four-way valves 26*a* and 26*b*. That is, the second four-way valves 26*a* and 26*b* are switched to couple the gas pipes 9 and the outdoor-unit high-pressure gas pipes 43*a* and 43*b* together and to couple the outdoor-unit low-pressure gas pipes 48*a* and 48*b* and the branch pipes of the outdoor-unit low-pressure gas pipes 48*a* and 48*b*. Accordingly, the gas pipes 9 and the outdoor-unit high-pressure gas pipes 43*a* and 43*b* are coupled together via the second coupling pipes 47*a* and 47*b*.

When the refrigerant circuit 100 is in the above-described state, the high-pressure refrigerants, which are compressed by the respective compressors 21*a* and 21*b* inside the outdoor units 2*a* and 2*b* and discharged from these units, flow through the discharge pipes 41*a* and 41*b* and flow in the outdoor-unit high-pressure gas pipes 43*a* and 43*b*. The refrigerants that have flowed in the outdoor-unit high-pressure gas pipes 43*a* and 43*b* flow in the second four-way valves 26*a* and 26*b*, and flow in the second coupling pipes 47*a* and 47*b* via the second four-way valves 26*a* and 26*b*.

The high-pressure refrigerants that have flowed in the second coupling pipes 47*a* and 47*b* flow in the gas pipes 9 via the closing valves 82*a* and 82*b*. The refrigerants flowing through the gas pipes 9 branch and flow in the respective indoor units 5*a* to 5*d* via the gas-pipe coupling portions 54*a* to 54*d*. The refrigerants that have flowed in the respective indoor units 5*a* to 5*d* flow through the indoor-unit gas pipes 72*a* to 72*d* and flow in the indoor heat exchangers 51*a* to 51*d*. These refrigerants are condensed by heat exchange with the indoor air taken into the indoor units 5*a* to 5*d* by rotations of the indoor fans 55*a* to 55*d* in the indoor heat exchangers 51*a* to 51*d*. As just described, functioning of the indoor heat exchangers 51*a* to 51*d* as condensers ensures air heating inside the room where the indoor units 5*a* to 5*d* are installed.

The high-pressure refrigerants that have flowed out of the indoor heat exchangers 51*a* to 51*d* flow through the indoor-unit liquid pipes 71*a* to 71*d* and pass through the indoor expansion valves 52*a* to 52*d* so as to be decompressed. The decompressed refrigerants flow in the liquid pipes 8 via the liquid-pipe coupling portions 53*a* to 53*d*. The refrigerants flowing through the liquid pipes 8 flow in the outdoor-unit liquid pipes 46*a* and 46*b* of the respective outdoor units 2*a* and 2*b* via the closing valves 81*a* and 81*b*.

The refrigerants that have flowed in the outdoor-unit liquid pipes 46*a* and 46*b* are further decompressed when passing through the outdoor expansion valves 24*a* and 24*b*, so as to be low-pressure refrigerants. These low-pressure refrigerants flow in the outdoor heat exchangers 23*a* and 23*b* via the outdoor-unit liquid pipes 46*a* and 46*b*. Then, these low-pressure refrigerants are evaporated by heat exchange with the ambient taken into the outdoor units 2*a* and 2*b* by rotations of the outdoor fans 25*a* and 25*b* in the outdoor heat exchangers 23*a* and 23*b*. The low-pressure refrigerants that have flowed out of the outdoor heat exchangers 23*a* and 23*b* flow through the first coupling pipes 45*a* and 45*b*, the first four-way valves 22*a* and 22*b*, and the intake branch pipes 49*a* and 49*b* in this order, and then flow in the intake pipes 42*a* and 42*b*, Then, the low-pressure refrigerants that have flowed in the intake pipes 42*a* and 42*b* are suctioned into the compressors 21*a* and 21*b* so as to be compressed again.

As described above, circulation of the refrigerant in the refrigerant circuit 100 ensures the heating operation of the air conditioner 1. At this time, the second four-way valves 26*a* and 26*b* cause flows of the high-pressure refrigerants discharged from the compressors 21*a* and 21*b*. On the other hand, the first four-way valves 22*a* and 22*b* cause flows of the low-pressure refrigerants suctioned into the compressors 21*a* and 21*b*.

<Heating Operation 2>

Next, a description will be given of the case (heating operation 2) where two indoor units perform heating operations, two indoor units are stopped, one outdoor unit operates, and one outdoor unit is stopped. Here, a description will be given of an example of the transition from the case of above-described heating operation 1, that is, the case where the four indoor units 5*a* to 5*d* perform heating operations and the two outdoor units 2*a* and 2*b* operate to the case where, as illustrated in FIG. 3, the two indoor units 5*c* and 5*d* are stopped and the outdoor unit 2*b* is also stopped correspondingly. Like heating operation 2 in this example, when the indoor units 5*a* and 5*b* operate and the indoor units 5*c* and 5*d* are stopped, one outdoor unit can cover the operation capacity required by the indoor units 5*a* and 5*b*. Accordingly, the outdoor unit 2*b* of the two outdoor units is stopped. Here, the outdoor unit 2*a* may be stopped while the outdoor unit 2*b* operates.

The first four-way valve 22*a* and the second four-way valve 26*a* in the operating outdoor unit 2*a* are in the states identical to the states when heating operation 1 is performed. On the other hand, in the stopped outdoor unit 2*b*, the compressor 21*b* and the outdoor fan 25*b* are stopped and the outdoor expansion valve 24*b* is fully closed. On the other hand, the first four-way valve 22*b* and the second four-way valve 26*b* in the outdoor unit 2*b* are maintained in the states when heating operation 1 is performed. That is, the first four-way valves 22*a* and 22*b* are switched to cause the state illustrated by the solid lines in FIG. 3, that is, to cause the communication between the port a and the port d and the communication between the port b and the port c. Accordingly, the outdoor heat exchanger 23*a* functions as an evaporator. Furthermore, the indoor heat exchangers 51*a* and 51*b* function as condensers. The second four-way valves 26*a* and 26*b* are also switched to cause the state illustrated by the solid lines, that is, to cause the communication between the port e and the port f and the communication between the port g and the port h. An indoor-unit controller (not illustrated) closes the indoor expansion valves 52*c* and 52*d* in the stopped indoor units 5*c* and 5*d*.

When the refrigerant circuit 100 is in the above-described state, the high-pressure refrigerant, which is compressed by the compressor 21*a* inside the operating outdoor unit 2*a* and discharged from this unit, flows through the discharge pipe 41*a* and flows in the outdoor-unit high-pressure gas pipe 43*a*. The refrigerant that has flowed in the outdoor-unit high-pressure gas pipe 43*a* flows in the second four-way valve 26*a*, and flows in the second coupling pipe 47*a* from the second four-way valve 26*a*.

The high-pressure refrigerant that has flowed in the second coupling pipe 47*a* flows in the gas pipe 9 via the closing valve 82*a*, and branches. The branched high-pressure refrigerants flow in the operating indoor units 5*a* and 5*b* via the gas-pipe coupling portions 54*a* and 54*b*, and flow in the stopped outdoor unit 2*b* via the closing valve 82*b*.

The high-pressure refrigerants that have flowed in the indoor units 5*a* and 5*b* flow through the indoor-unit gas pipes 72*a* and 72*b* and flow in the indoor heat exchangers 51*a* and 51*b*. These refrigerants are condensed by heat exchange with the indoor air taken into the indoor units 5*a* and 5*b* by rotations of the indoor fans 55*a* and 55*b* in the indoor heat exchangers 51*a* and 51*b*. As just described, functioning of the indoor heat exchangers 51*a* and 51*b* as condensers ensures air heating inside the room where the indoor units 5*a* and 5*b* are installed.

The high-pressure refrigerants that have flowed out of the indoor heat exchangers 51*a* and 51*b* flow through the indoor-unit liquid pipes 71*a* and 71*b* and pass through the indoor expansion valves 52*a* and 52*b* so as to be decompressed. The decompressed refrigerants flow in the liquid pipes 8 via the liquid-pipe coupling portions 53*a* and 53*b*. The refrigerants that have flowed through the liquid pipes 8 flow in the outdoor unit 2*a* via the closing valve 81*a* of the outdoor unit 2*a*, and flow in the outdoor-unit liquid pipe 46*a*.

On the other hand, the high-pressure refrigerant that has flowed in the outdoor unit 2*b* flows in the second four-way valve 26*b* via the second coupling pipe 47*b*. The high-pressure refrigerant that has flowed in the second four-way valve 26*b* flows in the discharge pipe 41*b* via the outdoor-unit high-pressure gas pipe 43*b*. The high-pressure refrigerant that has flowed in the discharge pipe 41*b* flows in the first four-way valve 22*b* and flows in the bypass pipe 40*b* from the first four-way valve 22*b*. The high-pressure refrigerant that has flowed in the bypass pipe 40*b* is decompressed by a capillary tube 27*b*, passes through the check valve 28*b*, and then flows in the outdoor-unit liquid pipe 46*b*. The refrigerant that has flowed in the outdoor-unit liquid pipe 46*b* flows in the liquid pipe 8 via the closing valve 81*b*. The refrigerant that has flowed in the liquid pipe 8 flows in the outdoor-unit liquid pipe 46*a* via the closing valve 81*a* of the outdoor unit 2*a*.

The refrigerant that has flowed in the outdoor-unit liquid pipe 46*a* is further decompressed when passing through the outdoor expansion valve 24*a* so as to be a low-pressure refrigerant. The refrigerant that has flowed in the outdoor heat exchanger 23*a* via the outdoor-unit liquid pipe 46*a* is evaporated by heat exchange with the ambient air taken into the outdoor unit 2*a* by rotation of the outdoor fan 25*a*. The low-pressure refrigerant that has flowed out of the outdoor heat exchanger 23*a* flows through the first coupling pipe 45*a*, the first four-way valve 22*a*, and the intake branch pipe 49*a* in this order, and then flows in the intake pipe 42*a*. Then, the low-pressure refrigerant that has flowed in the intake pipe 42*a* is suctioned into the compressor 21*a* so as to be compressed again.

The following describes the effects provided by the respective check valves 28*a* and 28*b* included in the bypass pipes 40*a* and 40*b*. The check valves 28*a* and *b* are disposed to regulate the flows of the refrigerants from the closing valves 81*a* and 81*b* toward the first four-way valves 22*a* and 22*b*. For example, in the case where the indoor units 5*c* and 5*d* are stopped when the refrigerant circuit 100 illustrated in FIG. 1 performs cooling operation and the outdoor unit 2*b* is stopped correspondingly, the compressor 21*b* and the outdoor fan 25*b* in the outdoor unit 2*b* are stopped and the outdoor expansion valve 24*b* is fully closed. On the other hand, the first four-way valves 22*a* and 22*b* and the second four-way valves 26*a* and 26*b* in the outdoor units 2*a* and 2*b* are in the states identical to the states when the cooling operation is performed. In the case where the cooling operation is continuously performed in this state, the refrigerant flows in the outdoor-unit liquid pipe 46*b* of the stopped outdoor unit 2*b* from the liquid pipe 8. In the refrigerant that has flowed in the outdoor-unit liquid pipe 46*b*, the refrigerant flowing toward the outdoor heat exchanger 23*b* is blocked by the fully-closed outdoor expansion valve 4*b*. On the other hand, the refrigerant flowing toward the first four-way valve 22*b* via the bypass pipe 40*b* is blocked by the check valve 28*b*. Accordingly, the refrigerant accumulates only between the closing valve 81*b* and the outdoor expansion value 24*b* in the outdoor-unit liquid pipe 46*b* and between the outdoor-unit liquid pipe 46*b* and the check valve 28*b* in the bypass pipe 40*b*. This minimizes the accumulation amount of the refrigerant in the stopped outdoor unit 2*b*.

In this embodiment, the bypass pipes 40*a* and 40*b* are provided with the check valves 28*a* and 28*b*. Instead, a solenoid valve such as a solenoid opening/closing valve and an electronic expansion valve may be provided. In this case, the outdoor-unit controllers 200*a* and 200*b* control the solenoid valves so that the solenoid valves are opened when the outdoor unit that the solenoid valves are disposed thereof is stopped during the heating operation, and are otherwise closed.

As described above, the air conditioner according to one embodiment of this disclosure includes the plurality of outdoor units of the triple-pipe air conditioner while the outdoor units can be used as outdoor units of the double-pipe air. conditioner. When at least one outdoor unit is stopped, a refrigerant might flow in the stopped outdoor unit from the gas pipe or the liquid pipe. In this case, during heating operation, it is possible to cause the refrigerant that has flowed in the outdoor unit from the gas pipe to flow out to the liquid pipe via the bypass pipe. During cooling operation, the refrigerant that has flowed in the outdoor unit from the liquid pipe flows to the bypass pipe but the flow of this refrigerant is blocked by the check valve. This prevents or inhibits the refrigerant from accumulating in the stopped outdoor unit.

The air conditioner according to one embodiment of this disclosure prevents or inhibits the refrigerant from accumulating in the stopped outdoor unit. Accordingly, when the stopped outdoor unit is restarted, this also prevents or inhibits a lack of refrigerating machine oil in the compressor of the restarted outdoor unit as described later.

Conventionally, during heating operation, when the refrigerant accumulates in the stopped outdoor unit, the refrigerant might flow in the compressor of this outdoor unit via the intake pipe and then accumulate. The refrigerant accumulating in the compressor is cooled by the ambient air and liquefied, and then the liquefied refrigerant merges into the refrigerating machine oil of the compressor. In this state, in the case where the stopped outdoor unit is restarted, the refrigerating machine oil is also discharged from the compressor together with the refrigerant. Accordingly, the compressor of the restarted outdoor unit might have a lack of the refrigerating machine oil. However, in the air conditioner according to one embodiment of this disclosure prevents or inhibits the refrigerant from accumulating in the stopped outdoor unit as described above. This prevents or inhibits a lack of the refrigerating machine oil caused by accumulation of the refrigerant in the compressor of the stopped outdoor unit.

Here, the air conditioner according to this embodiment includes the four indoor units and the two outdoor units. However, the embodiment of this disclosure is not limited to this. For example, the air conditioner may include three or more outdoor units and may include three or less or five or more indoor units. Furthermore, the counts of the indoor units and the outdoor units, which are installed on the air conditioner, may be changed as necessary. Furthermore, the counts of the operating indoor units and the operating outdoor units may be changed as necessary.

The air conditioner according to the embodiment of this disclosure may be the following first to third air conditioners.

The first air conditioner includes a plurality of outdoor units, which each include a compressor, an outdoor heat exchanger, a first flow-passage switcher, a second flow-passage switcher, a discharge pipe, an intake pipe, an outdoor-unit high-pressure gas pipe, an outdoor-unit low-pressure gas pipe, and an outdoor-unit liquid pipe, and an indoor unit, which is coupled to the outdoor unit by a liquid pipe and a gas pipe. The outdoor heat exchanger includes one refrigerant entry/exit opening coupled to the first flow-passage switcher by a refrigerant pipe and another refrigerant entry/exit opening coupled to the liquid pipe by the outdoor-unit liquid pipe. The discharge pipe couples a refrigerant discharge side of the compressor and the first flow-passage switcher together. The intake pipe couples a refrigerant intake side of the compressor and the first flow-passage switcher together. The second flow-passage switcher and the gas pipe are coupled together by a refrigerant pipe. The discharge pipe and the second flow-passage switcher are coupled together by the outdoor-unit high-pressure gas pipe. The intake pipe and the second flow-passage switcher are coupled together by the outdoor-unit low-pressure gas pipe. In this air conditioner, the outdoor-unit liquid pipe and the first flow-passage switcher are coupled together by a bypass pipe.

The second air conditioner according to the first air conditioner is provided with a solenoid valve or a check valve, which cause a refrigerant to flow only in a direction from the first flow-passage switcher toward the outdoor-unit liquid pipe, at the bypass pipe.

In the third air conditioner according to the first or second air conditioner, during heating operation, in the case where at least one outdoor unit in the plurality of outdoor units is stopped, the first flow-passage switcher and the second flow-passage switcher in the stopped outdoor unit are switched such that a refrigerant that has flowed in the stopped outdoor unit from the gas pipe flows out to the liquid pipe from this outdoor unit via the outdoor-unit high-pressure gas pipe and the bypass pipe.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An outdoor unit of an air conditioner coupled to an indoor unit by a liquid pipe and a gas pipe, comprising:

a compressor;

an outdoor heat exchanger;

a discharge pipe coupled to a refrigerant discharge side of the compressor; an intake pipe coupled to a refrigerant intake side of the compressor;

an outdoor-unit high-pressure gas pipe coupled to the discharge pipe;

an outdoor-unit low-pressure gas pipe coupled to the intake pipe;

an outdoor-unit liquid pipe that couples a first refrigerant entry/exit opening of the outdoor heat exchanger and the liquid pipe together;

a bypass pipe coupled to the outdoor-unit liquid pipe;

a first flow-passage switcher coupled to a second refrigerant entry/exit opening of the outdoor heat exchanger, the discharge pipe, the intake pipe, and the bypass pipe;

a second flow-passage switcher coupled to the gas pipe, the outdoor-unit high-pressure gas pipe, and the outdoor-unit low-pressure gas pipe, wherein the second flow-passage switcher comprises: a fifth port coupling to the outdoor-unit high-pressure gas pipe; a sixth port coupling to the gas pipe; and seventh and eighth ports coupling to the outdoor-unit low-pressure gas pipe; and wherein during heating operation, the first flow-passage switcher couples the second refrigerant entry/exit opening of the outdoor heat exchanger and the intake pipe together, and couples the discharge pipe and the bypass pipe together, and the second flow-passage switcher couples the gas pipe and the outdoor-unit high-pressure gas pipe together.

2. The outdoor unit of the air conditioner according to claim 1, further comprising a valve provided at the bypass pipe, the valve being for causing passage of a refrigerant from the first flow-passage switcher to the outdoor-unit liquid pipe and cutting off a refrigerant from the outdoor-unit liquid pipe toward the first flow-passage switcher.

3. The outdoor unit of the air conditioner according to claim 2, wherein the valve is one of a solenoid valve and a check valve.

4. The outdoor unit of the air conditioner according to claim 1, wherein during cooling operation, the first flow-passage switcher couples the second refrigerant entry/exit opening of the outdoor heat exchanger and the discharge pipe together, and couples the intake pipe and the bypass pipe together, and the second flow-passage switcher couples the outdoor-unit low-pressure gas pipe and the gas pipe together.

5. An air conditioner, comprising:

a plurality of the outdoor units according to claim 1;

the indoor unit; and the liquid pipe and the gas pipe that couple the outdoor units and the indoor unit together.

6. The outdoor unit of the air conditioner according to claim 1, wherein the first flow-passage switcher comprises a first port coupled to the second refrigerant entry/exit opening of the outdoor heat exchanger, a second port coupled to the discharge pipe, a third port coupled to the intake pipe, and a fourth port coupled to the bypass pipe, the outdoor-unit liquid pipe and the first flow-passage switcher are connected with each other by the bypass pipe, and the outdoor unit further comprises a valve provided at the bypass pipe, the valve being for causing passage of a refrigerant from the first flow-passage switcher to the outdoor-unit liquid pipe and cutting off a refrigerant from the outdoor-unit liquid pipe toward the first flow-passage switcher.

7. The outdoor unit of the air conditioner according to claim 2, further comprising a capillary tube provided at the bypass pipe at a position between the first flow-passage switcher and the valve, the capillary tube being configured to decompress the refrigerant from the first flow-passage switcher.

8. The outdoor unit of the air conditioner according to claim 1, wherein the second flow-passage switcher is connected with a branch pipe of the outdoor-unit low-pressure gas pipe, the branch pipe comprising a capillary tube.

9. The air conditioner according to claim 5, being a double-pipe conditioner.

10. The outdoor unit of the air conditioner according to claim 1, wherein the first flow-passage switcher comprises:

a first port coupling to the discharge pipe;

a second port coupling to a coupling pipe which couples to the second refrigerant entry/exit opening of the outdoor heat exchanger;

a third port coupling to the intake pipe; and a fourth port coupling to the bypass pipe, and during heating operation, the first port communicates with the fourth port to couple the discharge pipe and the bypass pipe together, and the second port communicates with the third port to couple the second refrigerant entry/exit opening of the outdoor heat exchanger and the intake pipe together.

11. The air conditioner according to claim 5, wherein when at least one of the plurality of the outdoor units is stopped during the heating operation, a refrigerant that has flowed in the stopped outdoor unit from the gas pipe flows out to the liquid pipe via the bypass pipe, and the refrigerant is prevented or inhibited from accumulating in the stopped outdoor unit.

12. The air conditioner according to claim 5, wherein when at least one of the plurality of the outdoor units is stopped during the heating operation, a refrigerant that has flowed in the stopped outdoor unit from the gas pipe flows out to the liquid pipe via the bypass pipe without flowing into the compressor and the outdoor heat exchanger.

13. The air conditioner according to claim 12, wherein the outdoor unit further comprises an outdoor expansion valve disposed at the outdoor-unit liquid pipe, and the outdoor expansion valve is fully closed in the stopped outdoor unit.

14. The outdoor unit of the air conditioner according to claim 10, wherein during cooling operation, a refrigerant flowed from the gas pipe flows into the outdoor-unit low-pressure gas pipe via the second flow-passage switcher and then flows into the compressor through the intake pipe, and the refrigerant discharged from the compressor flows in the first port to the second port of the first flow-passage switcher, then flows into the outdoor heat exchanger via the coupling pipe, and then flows to the liquid pipe through the outdoor-unit liquid pipe.

15. The outdoor unit of the air conditioner according to claim 10, wherein during the heating operation, a refrigerant flowed from the liquid pipe via the outdoor-unit liquid pipe flows into the outdoor heat exchanger, then flows into the intake pipe via the second port to the third port of the first flow-passage switcher, and then flows into the compressor, and the refrigerant discharged from the compressor flows through the discharge pipe to the outdoor-unit high-pressure gas pipe, and then flows into the gas pipe via the second flow-passage switcher.

16. An outdoor unit of an air conditioner coupled to an indoor unit by a liquid pipe and a gas pipe, comprising:

a compressor;

an outdoor heat exchanger;

a discharge pipe coupled to a refrigerant discharge side of the compressor;

an intake pipe coupled to a refrigerant intake side of the compressor;

an outdoor-unit high-pressure gas pipe coupled to the discharge pipe;

an outdoor-unit low-pressure gas pipe coupled to the intake pipe;

an outdoor-unit liquid pipe that couples a first refrigerant entry/exit opening of the outdoor heat exchanger and the liquid pipe together;

a bypass pipe coupled to the outdoor-unit liquid pipe;

a first flow-passage switcher coupled to a second refrigerant entry/exit opening of the outdoor heat exchanger, the discharge pipe, the intake pipe, and the bypass pipe; and a second flow-passage switcher coupled to the gas pipe, the outdoor-unit high-pressure gas pipe, and the outdoor-unit low-pressure gas pipe, wherein the first flow-passage switcher comprises:

a first port directly coupling to the discharge pipe;

a second port directly coupling to a coupling pipe which directly couples to the second refrigerant entry/exit opening of the outdoor heat exchanger;

a third port directly coupling to the intake pipe; and a fourth port directly coupling to the bypass pipe, and during heating operation, the first port communicates with the fourth port to couple the discharge pipe and the bypass pipe together, and the second port communicates with the third port to couple the second refrigerant entry/exit opening of the outdoor heat exchanger and the intake pipe together.

* * * * *